United States Patent [19]

Enen, Jr. et al.

[11] 4,390,064

[45] Jun. 28, 1983

[54] JUNK BASKET

[75] Inventors: Jack Enen, Jr., Dallas; Wayne M. Sullivan, Houston, both of Tex.

[73] Assignee: Enen Machine Tool & Equipment Co., Dallas, Tex.

[21] Appl. No.: 197,862

[22] Filed: Oct. 17, 1980

[51] Int. Cl.[3] ..... E21B 31/08

[52] U.S. Cl. ..... 166/99; 166/162; 403/371

[58] Field of Search ..... 166/99, 117, 162, 202; 175/308; 403/371

[56] References Cited

U.S. PATENT DOCUMENTS

| | | | |
|---|---|---|---|
| 1,035,161 | 8/1912 | Cortinas | 166/99 |
| 2,657,752 | 11/1953 | Ballew et al. | 166/99 |
| 2,670,930 | 3/1954 | Farrar | 166/99 |
| 2,801,079 | 7/1957 | Gress | 166/162 |
| 3,009,747 | 11/1961 | Pitzer | 403/371 |
| 4,258,804 | 3/1981 | Richey et al. | 166/241 |

*Primary Examiner*—William F. Pate, III

*Attorney, Agent, or Firm*—Fulbright & Jaworski

[57] ABSTRACT

A junk basket for collecting junk from a well bore and adapted for external connection to a well drilling string. The junk basket includes an elongate body having an annular interior for a releasable attachment to the exterior of a portion of the drilling string. The body includes an upwardly directed cavity for receiving junk from the well bore and one or more drain holes through the body adjacent the bottom of the cavity for draining fluid. Ribs are provided in the cavity connected to the body for engaging the exterior of the drilling string for reinforcing the body and guide means, preferably positioned on the top of the ribs, extend upwardly for preventing the top of the body from catching on downwardly facing shoulders in the well bore. The junk basket may be releasably connected to a drilling string by providing a downwardly facing shoulder in the interior of the body and resilient male and female split rings positioned in the interior of the body which are actuated by an end cap threadably connected to the body. Axial movement of the end cap causes axial movement of the rings relative to each other for engaging or disengaging the drilling string. Positive locking screws and elongate slots are provided on the body and end cap for rotationally locking the body and cap together.

5 Claims, 6 Drawing Figures

JUNK BASKET

BACKGROUND OF THE INVENTION

It is old to utilize a boot-type junk basket to keep the well bore clean as the well bore is drilled. This is especially important when utilizing rock bits in which the carbide inserts may fracture and separate. However, conventional boot-type junk baskets have been connected in the drilling string thereby providing a weak point in the drill string. Such weak points have often yielded during drilling operations and caused complicated fishing jobs. Because conventional junk baskets created additional risks, drilling operators have used them only when necessary. However, it is important to utilize a junk basket as it helps keep the well bore clean thereby increasing the life of the drilling bit in all drilling conditions thereby allowing an increased drilling time on bottom which in turn reduces the drilling cost.

The present invention is directed to an improved junk basket which is externally attached to a drilling string including the drill collars or drill pipe whereby the drilling string maintains its full strength and is not dependent upon the junk basket for its strength thereby eliminating the problem of twist off in or at the junk basket. In addition, the present junk basket may be utilized with downhole motors or turbines as well as with drill bits.

SUMMARY

It is an object of the present invention to provide a junk basket for collecting junk from a well bore and adapted for connection to the exterior of a well drilling string and includes an elongate body having an annular interior for attachment to the exterior of a portion of the drilling string and means for releasably connecting the body to the drilling string. The body includes an upwardly directed cavity for receiving junk from the well bore and one or more drain holes are provided through the body adjacent the bottom of the cavity for draining fluid from the cavity. Ribs are provided in the cavity connected to the body and adapted to engage the exterior of the drilling string for reinforcing the body.

It is a further object of the present invention to provide guide means extending upwardly from the top of the body for preventing the top of the body from catching on downwardly facing shoulders in the well bore. Preferably the guide means includes tapered surfaces positioned on top of the ribs.

A still further object of the present invention is the provision of means for releasingly connecting the body to the exterior of a drilling string which includes a downwardly facing annular shoulder in the exterior of the body and first and second split rings positioned in the interior of the body with the first ring positioned against the shoulder. The rings include coacting conical surfaces whereby axial movement of the rings toward each other causes one of the rings to clamp on the exterior of the drilling string. An end cap is threadably connected to the body and interlocks with one of the rings whereby rotational movement of the cap relative to the body causes axial movement of the rings relative to each other.

Preferably the releasing connecting means includes a resilient male split ring positioned in the interior of the body against the downwardly facing shoulder with a resilient female split ring positioned against the male ring and the end cap is interlocked with the female split ring whereby rotational movement of the cap causing axial movement of the rings toward each other causes the male ring to clamp on the exterior of the drilling string and reverse rotational movement of the end cap releases the connecting means from the drilling string.

Still a further object of the present invention is the provision of a positive locking mechanism for locking the end cap to the body in spite of varying longitudinal displacement of the end cap relative to the body. The body includes a plurality of equally spaced screw holes positioned circumferentially around the body with the screw holes positioned at different vertical positions. The end cap includes a plurality of equally spaced elongated openings positioned circumferentially. The openings are spaced whereby when one opening is circumferential with one of the holes, other of the openings will be circumferentially aligned with other screw holes. At least one screw is positioned in one of the screw holes and engages one of the elongated openings for preventing rotation between the body and the end cap. Indicating lines may be provided on the circumference of the end cap for aligning the openings with the screw holes.

Other and further objects, features and advantages will be apparent from the following description of a presently preferred embodiment of the present invention given for the purose of disclosure when taken in conjunction with the accompanying drawings.

DESCRIPTION OF THE PREFERRED EMBODIMENT

Figure 1:
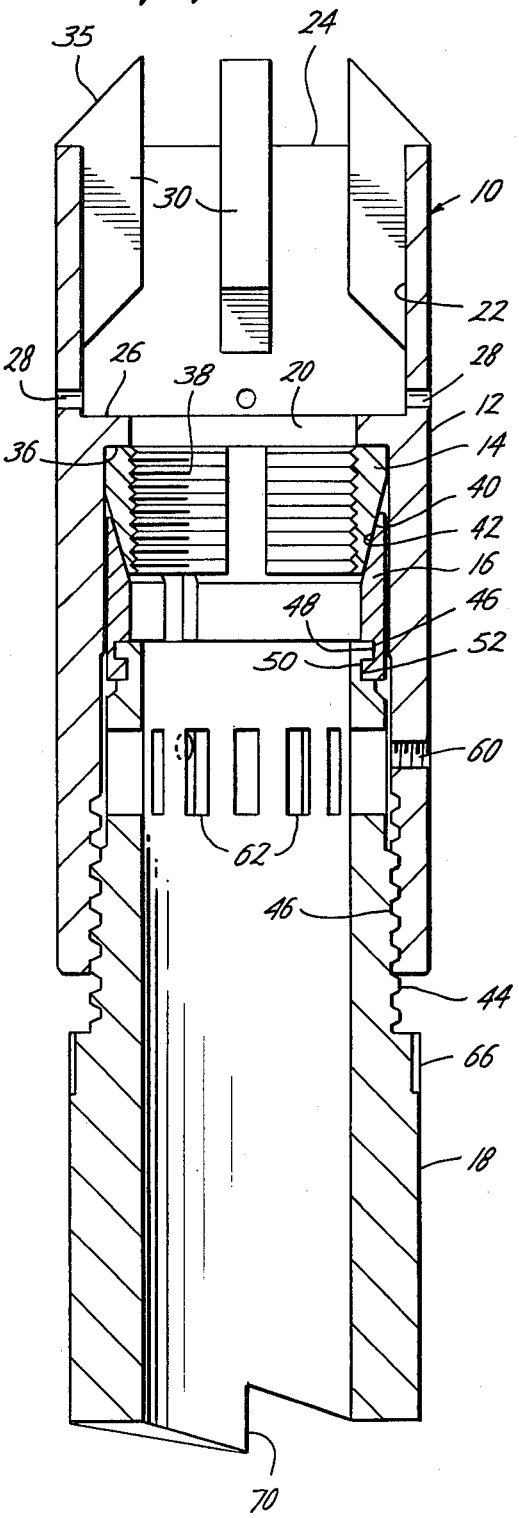
FIG. 1 is an elevational view, in cross section, of the junk basket of the present invention in the unset position.
Figure 2:
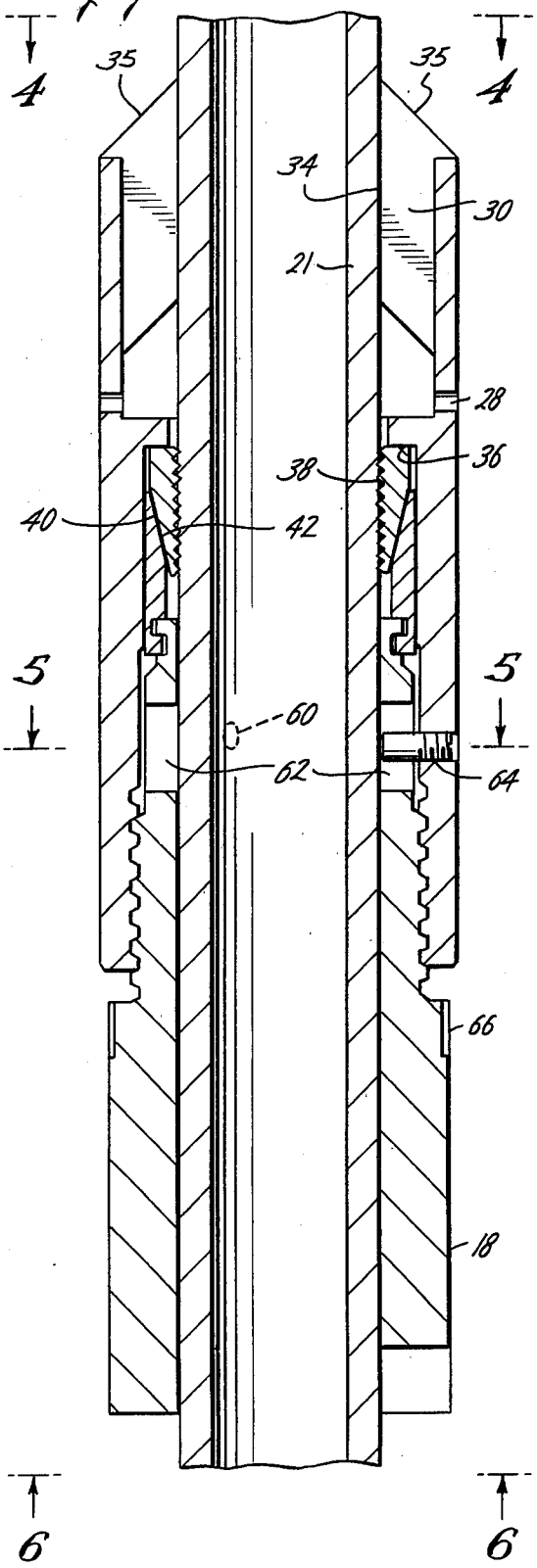
FIG. 2 is an elevational view, in cross section, of the present invention slideably locked on a portion of the drilling string.
Figure 3:
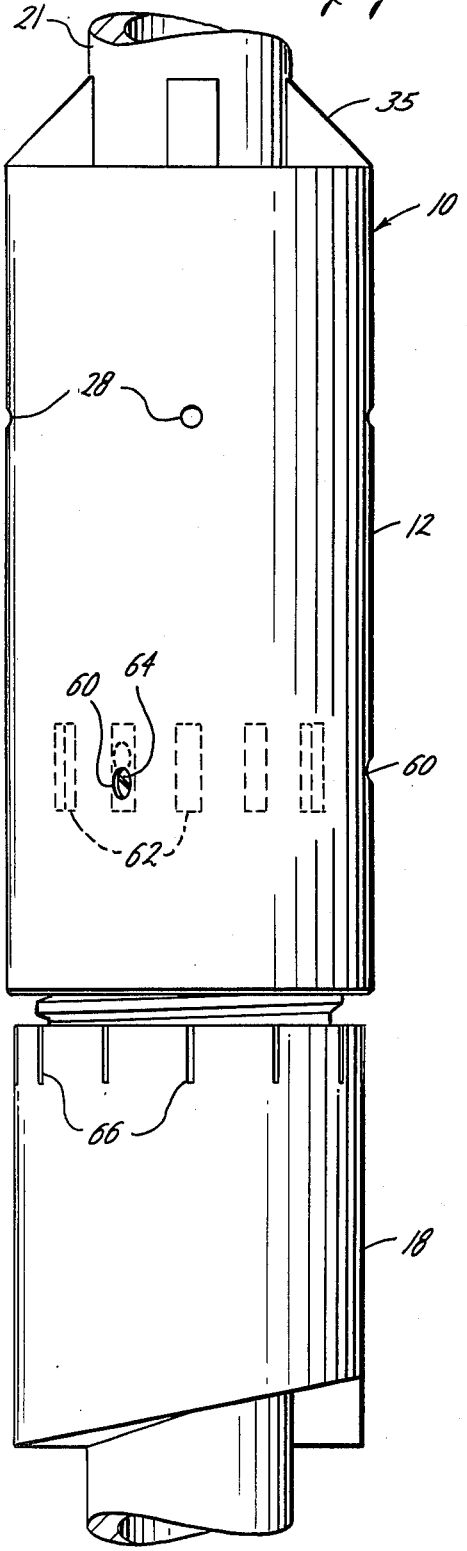
FIG. 3 is an elevational view illustrating the present invention securely connected to a portion of the drilling string.
Figure 4:
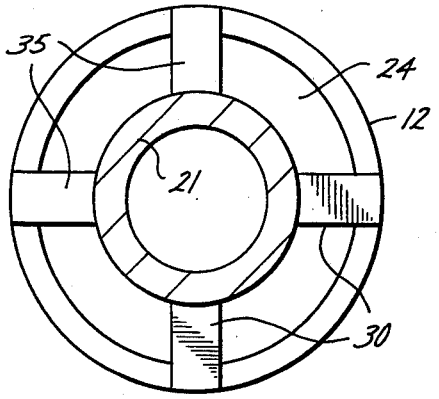
FIG. 4 is a cross-sectional view taken along lines 4—4 of FIG. 2.
Figure 5:
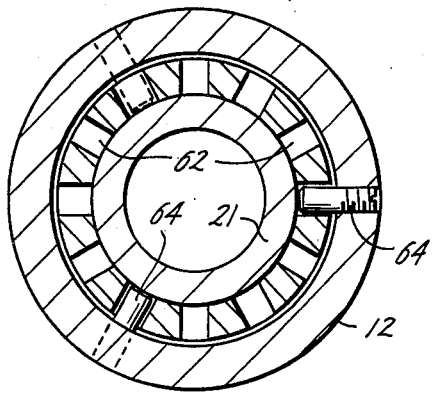
FIG. 5 is a cross-sectional view taken along lines 5—5 of FIG. 2.
Figure 6:
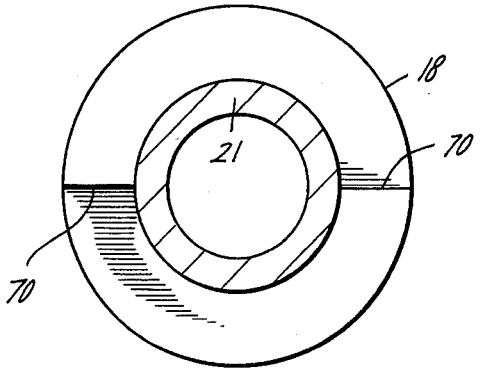
FIG. 6 is a cross-sectional view taken along lines 6—6 of FIG. 2.

Referring now to the drawings, the reference numeral 10 generally indicates the junk basket of the present invention which generally includes a body 12, first and second split locking rings 14 and 16, and an end cap 18.

The elongate body 12 includes an annular interior or bore 20 for slideably engaging the exterior of a portion of a drilling string 21. The body 12 also includes an upwardly directed cavity 22 having an open end 24 for receiving junk from the well bore. At the bottom of the cavity 22 a ledge 26 is provided for retaining any junk caught in the cavity 22. Also adjacent the bottom of the cavity 22 and extending through the body 12 are one or more drain holes 28 for draining fluid from the cavity 22. However, the holes 28 are small enough to retain junk which might interfere with the drilling of the well bore.

A plurality of axially extending ribs 30 are provided in the cavity and connected to the body 12 having an interior surface 32 adapted to engage the exterior of the drilling string for supporting and reinforcing the body 12. Guide means are provided extending upwardly from the top of the body 12 for preventing the top of the body from catching on downwardly facing shoulders in the well bore such as a well casing. Preferably, the guide means include tapered surfaces 35 positioned on the top of the ribs 30.

Suitable means are provided for releasably connecting the body 12 to the exterior of the drilling string whereby the drilling string provides the necessary strength for drilling the well bore and the junk basket 10 merely functions to remove junk from the well bore and is not required to transmit drilling forces through the drilling string. The releasable connecting means preferably includes a downwardly facing annular shoulder 36 in the interior of the body 12. A first resilient male split ring 36 is adapted to be positioned in the interior of the body 12 and against the shoulder 36. The ring 14 preferably includes serrations 38 on the interior of the ring 14 for gripping and locking on the exterior of the drilling string 21. A second or resilient female split ring 16 is positioned in the interior of the body 12 and in contact with the male ring 14. The male and female split rings 14 and 16 include coacting conical surfaces 40 and 42, respectively, whereby axial movement of the rings 14 and 16 towards each other causes the male ring 14 to move inwardly to clamp on the exterior of the drilling string 21. Axial movement of the rings away from each other allows the resilient male ring 14 to expand and become disengaged from the exterior of the drilling string 21.

The end cap 18 includes threads 44 for coacting with internal threads 46 of the body 12 whereby the end caps 18 may be threaded and unthreaded from the body 12. The end cap 18 is mechanically interlocked with one of the rings 14 and 16 such as ring 16 whereby rotational movement of the cap 18 relative to the body 16 causes axial movement of the rings 14 and 16 relative to teach other. Preferably, the mechanical interlock includes an annular rib 46 on the end cap 18 which mates in a groove 48 on the female ring 16 and with a rib 50 on the ring 16 mating in a groove 52 on the end cap 18. Thus, axial movement of the end cap 18 in either direction carries the female ring 16 in the same axial direction.

Preferably, additional locking means are provided for locking the end cap to the body 12 in spite of the varying longitudinal displacement of the end cap relative to the body 12 as the end cap 18 is torqued up in tightening the split rings 14 and 16. Thus a plurality of equally spaced screw holes 60, such as three holes spaced 120 degrees apart, are positioned circumferentially around the body 12. The holes 60 are positioned at different vertical positions. A plurality of equally spaced elongated openings 62, such as twelve openings spaced thirty degrees apart, are provided in the end cap 18 circumferentially positioned. It is noted that when one of the openings 62 is circumferentially aligned with one of the screw holes 60, other of the openings 62 will be aligned with other of the screw holes 60. Because the holes 60 are vertically spaced with each other and because the openings 62 are elongated, at least one of the holes 60 will come into registry with one of the openings 62 in spite of the fact that axial spacing of the body 12 relative to the end cap 18 may vary depending on the degree of makeup of the threads 44 and 46. A screw 64 is positioned in at least one of the holes 60 and engages one of the openings 62 for preventing rotational movement between the body 12 and the end cap 18.

Preferably a plurality of equally spaced indicating lines 66, such as twelve lines spaced thirty degrees apart aligned with the openings 62, are provided about the outer circumference of the end cap 18 for ease of visually aligning the openings 62 with the holes 60 upon makeup of the basket 10 on the drill string 21. The bottom of the end cap 18 includes downwardly directed shoulders 70 which if they engage any object such as the wall of the well bore act in a direction on the end cap 18 to tighten the basket 10 on the drilling string 21 as the string 21 is rotated clockwise for drilling.

In use, the junk basket 10 may be assembled with the end cap 18 loosely threaded to the body 12. The junk basket 10 may be slid over a section of the drilling string at the desired point on the drilling string. The end cap 18 is then tightened by rotation driving the female split ring 16 towards the male thread ring 14. The coacting tapering surfaces 40 and 42 will coact to move the male split ring 14 radially inwardly to grip the exterior of the drilling string. The serrations 38 on the interior of the ring 14 will lock the junk basket 10 to the exterior of the drilling string. After attainment of approximately the proper makeup torque, the end cap 18 further rotated to visually align one of the indicating lines with the holes 60 which aligns the elongate openings 62 with the holes 60. A screw 64 is then inserted into a hole 60 which is in registry with one of the openings 60 for securely locking the body 12 relative to the end cap 18 and thus securely locking the basket 10 to the drilling string 21. The drill string amy be conventionally used and the junk basket will act to collect junk from the well bore, but will not weaken the drill string and is not required to carry any of the drilling load.

When it is desired to remove the junk basket 10 from a joint or drilling string, the screw 64 is removed and the end cap 18 is rotated away from the body 10 and will carry the female member 16 away from the male member 14 and the resilience of the rings 14 and 16 will cause them to retract from the exterior surface of the drilling string. Junk basket 10 can then be slideably removed from the drill string joint.

The present invention, therefore, is well adapted to carry out the objects and attain the ends and advantages mentioned as well as others inherent therein. While a presently preferred embodiment of the invention is given for the purpose of disclosure, numerous changes in the details of construction of and arrangement of parts will readily suggest themselves to those skilled in the art and which are encompassed within the spirit of the invention and the scope of the appended claims.

What is claimed is:

1. A junk basket for collecting junk from a well bore and adapted for connection to a well drilling string comprising, an elongate body having an annular interior for attachment to the exterior of a portion of a drilling string, said body including an upwardly directed cavity for receiving junk from the well bore, drain holes through the body adjacent the bottom of the cavity for draining fluids from the cavity, ribs in the cavity connected to the body and adapted to engage the exterior of the drilling string for reinforcing the body, tapered guide means extending upwardly from the top of the ribs for preventing the top of the body from catching on downwardly facing shoulders in the well bore, means connected to the body for releasably connecting the body to the exterior of the drilling string including, a downwardly facing annular shoulder in the interior of the body, a resilient male split ring positioned in the interior of the body against the shoulder, a resilient female split ring positioned in the interior of the body against the male ring, said male and female split rings having coacting conical surfaces whereby axial movement of the rings toward each other causes the male ring to clamp on the exterior of the drilling string, and an end cap threadedly connected to the body, said end cap interlocked with the female split ring whereby rotational movement of the cap relative to the body causes axial movement of the rings relative to each other.

2. The apparatus of claim 1 including means for locking said end cap to the body including, a plurality of equally spaced screw holes positioned circumferentially around the body, said screw holes positioned at different vertical positions, a plurality of equally spaced elongated openings in said end cap positioned circumferentially, said openings spaced whereby when one opening is circumferentially aligned with one of the screw holes other of the openings will be circumferentially aligned with the other screw holes, and at least one scew positioned in one of the screw holes and engaging one of the elongated openings for preventing rotational movement between the body and the end cap.

3. The apparatus of claim 2 including, indicating lines on the outer circumference of the end cap aligned vertically with said openings for aligning the openings with the screw holes.

4. A junk basket for collecting junk from a well bore and adapted for connection to the exterior of a well drilling string comprising, an elongate body having an annular interior for attachment to the exterior of a portion of a drilling string, a downwardly facing annular shoulder in the interior of the body, a first and second split ring positioned in the interior of the body, the first ring being positioned against the shoulder, said rings including coacting conical surfaces whereby axial movement of the rings toward each other causes one of the rings to clamp on the exterior of the drilling string.

an end cap threadedly connected to the body, said end cap interlocked with one of the rings whereby rotational movement of the cap relative to the body causes axial movement of the rings relative to each other, said body including an upwardly directed cavity for receiving junk from the well bore, drain holes through the body adjacent the bottom of the cavity for draining fluids from the cavity, and ribs in the cavity connected to the body and adapted to engage the exterior of the drilling string for reinforcing the body.

5. The apparatus of claim 4 including means for locking said end cap to the body including, a plurality of equally spaced screw holes positioned circumferentially around the body, said screw holes positioned at different vertical positions, a plurality of equally spaced elongated openings in said end cap positioned circumferentially, said openings spaced whereby when one opening is circumferentially alligned with one of the screw holes other of the openings will be circumferentially aligned with the other screw holes, and at least one screw positioned in one of the screw holes and engaging one of the elongated openings for preventing rotational movement between the body and the end cap.

* * * * *